US006311536B1

(12) United States Patent
Fehlemann

(10) Patent No.: US 6,311,536 B1
(45) Date of Patent: Nov. 6, 2001

(54) METHOD FOR MANUFACTURING FORGED WIDE SIDEWALLS OF A CONTINUOUS CASTING MOLD

(75) Inventor: Gereon Fehlemann, Düsseldorf (DE)

(73) Assignee: SMS Schloemann-Siemag Aktiengesellschaft, Düsseldorf (DE)

( * ) Notice: Subject to any disclaimer, the term of this patent is extended or adjusted under 35 U.S.C. 154(b) by 0 days.

(21) Appl. No.: 09/591,096

(22) Filed: Jun. 8, 2000

(30) Foreign Application Priority Data

Jun. 16, 1999 (DE) ..... 199 27 348

(51) Int. Cl.[7] ..... B21K 23/00
(52) U.S. Cl. ..... 72/377
(58) Field of Search ..... 72/377

(56) References Cited

U.S. PATENT DOCUMENTS 3,568,492 * 3/1971 Moore ..... 72/377

FOREIGN PATENT DOCUMENTS 4233739 4/1994 (DE) .

0149734 4/1988 (EP) .

* cited by examiner

*Primary Examiner*—Lowell A. Larson
(74) *Attorney, Agent, or Firm*—Friedrich Kueffner

(57) ABSTRACT

In a method for manufacturing a sidewall member of a continuous casting mold from a copper blank, wherein the sidewall member has an upper and a lower edge and a curved widened area beginning at the upper edge and tapering in a direction to the lower edge and to the sides of the sidewall member, the copper blank is hot-forged via several intermediate shapes to a rectangular plate with an initial wedge shape. The rectangular plate is then further formed by final hot-forging in a longitudinal direction of the rectangular plate with a straight saddle, having a width that is only a portion of a width of the rectangular plate measured relative to the longitudinal direction of the rectangular plate, and the curved widened area is pre-forged. Subsequently, the rectangular plate is quenched and work-hardened. The rectangular plate is then cold-hammered via a wedge-shaped bottom saddle for work-hardening a middle portion of the rectangular plate and for producing a final wedge shape of the rectangular plate. Finally, the entire curved widened area is work-hardened with a narrow saddle.

5 Claims, 3 Drawing Sheets

FIG. 1a
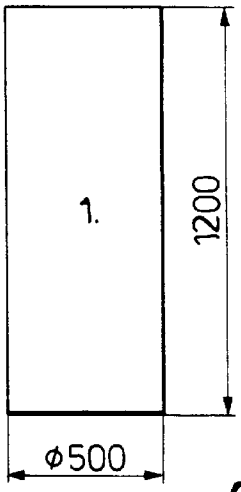
FIG. 1b
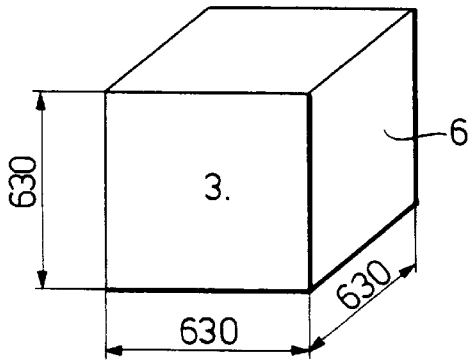
FIG. 1c
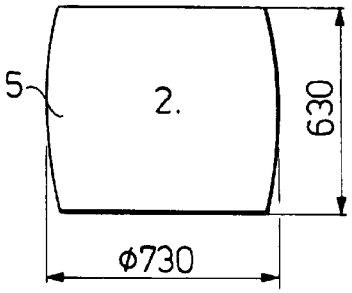
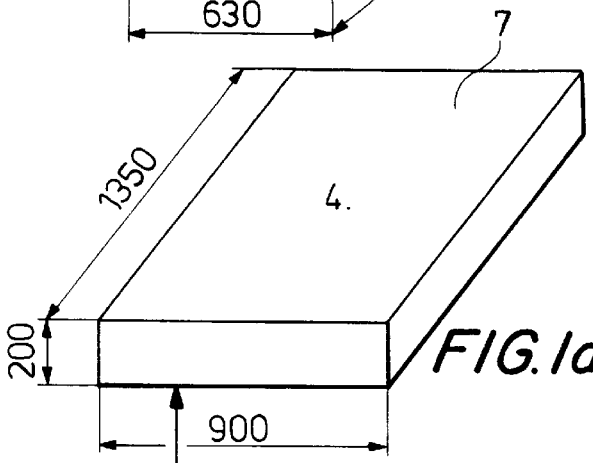
FIG. 1d
FIG. 1e
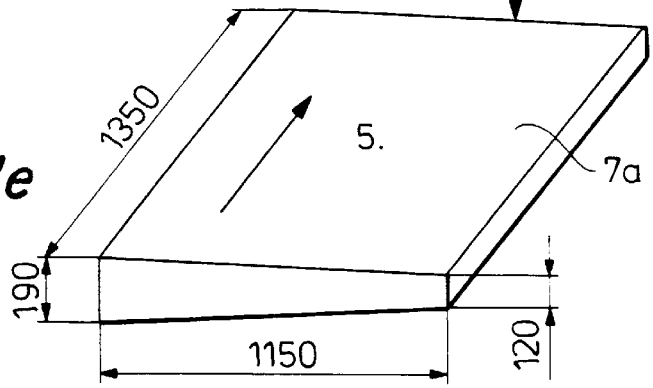
FIG. 1f
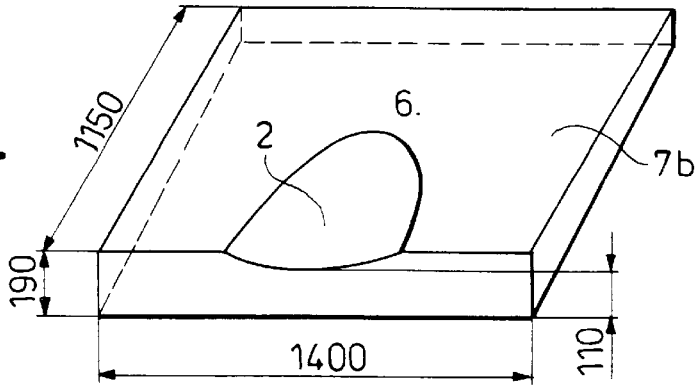

METHOD FOR MANUFACTURING FORGED WIDE SIDEWALLS OF A CONTINUOUS CASTING MOLD

BACKGROUND OF THE INVENTION

1. Field of the Invention

The invention relates to a method for manufacturing a wide sidewall of a mold for continuous casting, in particular, for thin slab continuous casting devices, wherein the wide sidewall is forged from a preferably cylindrical copper blank and has a curved widened area or funnel area extending from the upper edge and tapering to the sides and in the downward direction.

2. Description of the Related Art

Open-ended molds are used for the continuous casting of slab and are comprised of two wide sidewalls and two narrow sidewalls. Open-ended molds whose wide sidewalls have, at least over a portion of their width and height, a widened area are used, in particular, for casting thin slabs and steel strips.

For producing such wide sidewalls comprised of copper different methods are known, for example, forming under tensile conditions or forming under combination of tensile and compressive conditions or rolling. From German patent document DE 42 33 729 A1 it is known to provide a bottom die with a forming surface for receiving the wide sidewall of the mold. The bottom die has coordinated therewith a pressure plate which has numerous pressure screws with foot plates whose surfaces together define the pressure surface and work the mold plate.

These manufacturing possibilities are as complicated and require as high a labor and material expenditure as a forging process of the aforementioned kind performed as an experiment. The cylindrical copper blanks which are formed in this process to a wedge-shaped copper plate have a great blank weight because of the dimensions required for forging-technological processing and require five hot-forging steps and six partial cold-hammering steps.

SUMMARY OF THE INVENTION

It is an object of the present invention to provide a method of the aforementioned kind which makes it possible to forge wide sidewalls of molds in an economical way and with improved quality.

In accordance with the present invention, this is achieved in that:

- in several hot-forging steps the copper blank is formed via intermediate shapes to a rectangular plate with simultaneous forming of the wedge shape in the same hot-forging process;
- in a subsequent final further hot-forging step, the wedge-shaped rectangular plate is further formed in its longitudinal direction with a straight saddle, whose width is only a portion of the width measurement of the plate relative to the longitudinal direction of the plate, and the funnel is already partially forged in this process;
- the rectangular plate is subsequently quenched and work-hardened;
- subsequently, for work-hardening the middle portion of the plate and for producing the final wedge shape, cold-hammering by means of a correspondingly wedge-shaped bottom saddle is carried out; and
- in a final step, the entire funnel area is work-hardened by a narrow saddle.

These measures make it possible to forge a wedge-shaped wide sidewall member with funnel-like widened area and unchanged length of the wide sidewall member in the casting direction, with respect to the later mounting in a continuous casting device, despite fewer forming steps in comparison to conventional forging processes and despite a reduced blank weight of the copper blank or round block. This is achieved according to the invention primarily by the forming of the intermediate shape into a rectangular plate and the simultaneous forming of the basic wedge shape in the same hot-forging process. Moreover, forging on the straight saddle, which is approximately 350 mm wide in the longitudinal direction, i.e., the direction of the greatest longitudinal extension of the plate, and the partial forging of the funnel already occurring in this process are also contributing factors. With the subsequent processing on a wedge-shaped bottom saddle, the final shape with simultaneous work-hardening of the plate is produced wherein especially the middle portion of the plate is work-hardened by approximately 25%. This causes the plate to be extend in the lower area. In contrast, the final work-hardening of the funnel area, preferably by about 25%, results in the plate now being extended in the upper area.

An advantageous measure proposes a cold-hammering by means of a profiled bottom saddle after quenching and work-hardening of the plate. Accordingly, the wedge-shaped rectangular plate is worked by cold-hammering and extended in the longitudinal direction transverse to the future casting direction for the purpose of work-hardening of the edge areas by means of a straight top saddle and a profiled bottom saddle, wherein the linear dimensions of the top and bottom saddles are greater than those of the rectangular plate. The plate in this process is forged transverse to the casting direction wherein the edge areas are work-hardened by approximately 25% in one or more steps; the number of steps depends on the compressive force of the used forging press. The intermediate step of forging by means of a profiled bottom saddle is, in general, to be used when the available forging force is insufficient; otherwise, the hot-forging of the initial wedge shape could be followed immediately by forging of the forging-technological final shape with work-hardening.

According to a preferred embodiment of the method according to the invention, a copper blank (in view of the unavoidable large tolerances resulting from forging, the following measurements are only approximate dimensions) in the shape of a round block with a diameter of 500 mm and a length of 1,200 mm is formed in the hot-forging steps first to a rectangular plate with the dimensions 1,350 mm×900 mm×200 mm and then to a wedge-shaped rectangular plate with the dimensions 1,350 mm×1,150 mm×120/190 mm, and, subsequently, by cold-hammering steps with simultaneous work-hardening in the edge areas and in the middle portion by approximately 25% to the final shape of 1,800 mm×1,150 mm×80/140 mm. A wide sidewall member produced in this way has, which holds true also for a rectangular shape of the initial blank, improved properties and thus a higher quality, with positive effects in regard to the service life, in comparison to-conventional plates due to the more uniform forming and the work-hardening, especially in the funnel area. Because of the reduced blank weight, there is not only a greater saving with regard to material, but moreover the furnace costs are also reduced. Finally, the forging time is reduced because the plate must no longer be divided into six portions in the work-hardening process, as has still been required in the experiments. Because the finished wide sidewall member has moreover a greater flatness, this also results in a reduced expenditure for after processing by milling.

BRIEF DESCRIPTION OF THE DRAWING

The drawing very schematically illustrates one embodiment of the method in connection with forging, starting with a cylindrical copper blank and including the forging step by means of a profiled bottom saddle.

In the drawing:

FIGS. 1*a–f* illustrate the different forming steps during forging of a wide sidewall member starting with a cylindrical round block and ending with a rectangular plate with already partially forged funnel area;

DESCRIPTION OF THE PREFERRED EMBODIMENTS

Figure 4:
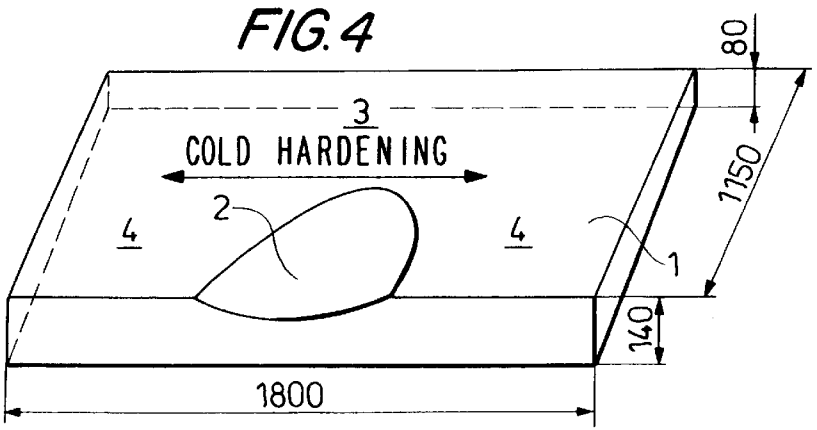
FIG. 4 shows the wide sidewall member produced by hot-forging and cold-hammering according to FIGS. 1 through 3.

The blank material for producing a wide sidewall member 1 for a mold of a thin slab casting device, wherein the wide sidewall member 1 is provided with a curved widened area or funnel 2 beginning at the upper edge and tapering to the lateral and lower formed surfaces 3, 4 (compare FIGS. 4 and 5) is, according to the embodiment of the invention, a copper blank in the form of a round block with a diameter of 500 mm and a length of 1,200 mm. According to FIG. 1, this copper blank is first formed to a barrel-shaped intermediate shape 5 in a first hot-forging step, subsequently forged to a substantially square block 6, and then to a rectangular plate 7 with the dimensions 1,350 mm×900 mm×200 mm. In the same hot-forging process, the wedge shape (see FIG. 1, reference numeral 5) is subsequently produced so that the rectangular plate 7*a* has a wedge shape with the dimensions 1,350 mm×1,150 mm×120/190 mm. The plate 7*a* is then worked in the last hot-forging process in the longitudinal direction (compare the arrow drawn within the plate 7*a*) by means of a straight saddle, and the funnel 2 is already partially forged. The thickness in the funnel center at the upper edge in the shown embodiment is 110 mm so that there is still sufficient material for the later work-hardening process.

Figure 2B:
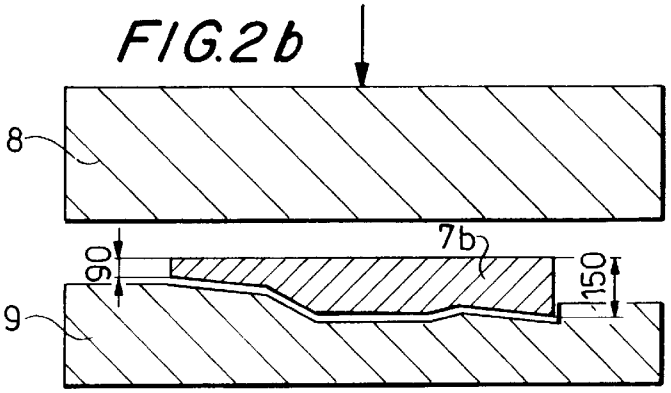
FIGS. 2*a*, 2*b* show a first cold-hammering step before (FIG. 2*a*) and after (FIG. 2*b*) placing the rectangular plate according to FIG. 1 onto a profiled bottom saddle of the two-part tool.
Figure 3:
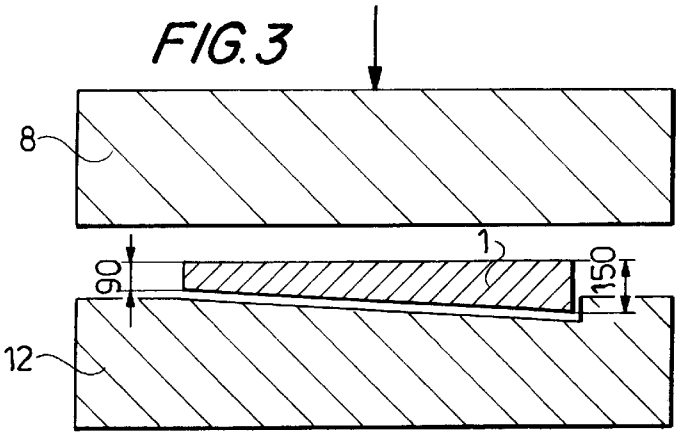
FIG. 3 shows a second cold-hammering step for producing the wedge-shape of the finished rectangular plate or wide sidewall member.
Figure 2A:
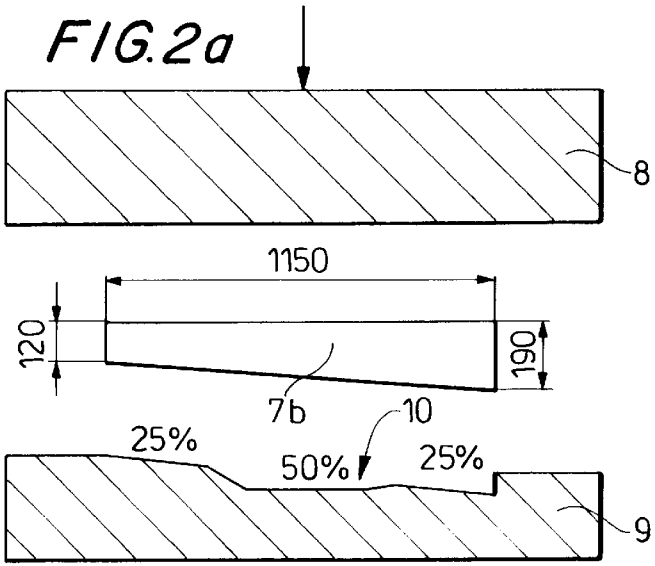

The wedge-shaped rectangular plate 7*b* accordingly produced with a partial funnel area is quenched and work-hardened. Subsequently, the plate is placed onto a profiled bottom saddle 9 (compare FIGS. 2*a*, 2*b*) and its underside is profiled in a first cold-hammering step by means of a top saddle 9 according to the profilings 10 of the bottom (profile) saddle 9 and is accordingly extended in the longitudinal direction. The cold-hammering is carried out transverse to the future casting direction 11 (see arrow in FIG. 5) wherein the edge areas are work-hardened in one or more steps, depending on the compressive force of the employed forging press, by approximately 25%. As illustrated in FIG. 3, the plate is placed in a second work-hardening step onto a wedge-shaped bottom saddle 12 and is formed to the wide sidewall member 1 according to FIG. 4 wherein in this second cold-hammering step the plate is work-hardened in its middle portion by approximately 25%. The thus cold-hammered wide sidewall member 1 has the dimensions 1,800 mm×1,150 mm×80/140 mm. As an alternative, the forging process can also be performed without the afore described—first—cold-hammering step by means of a profiled bottom saddle when the forging power is sufficient.

Figure 5A:
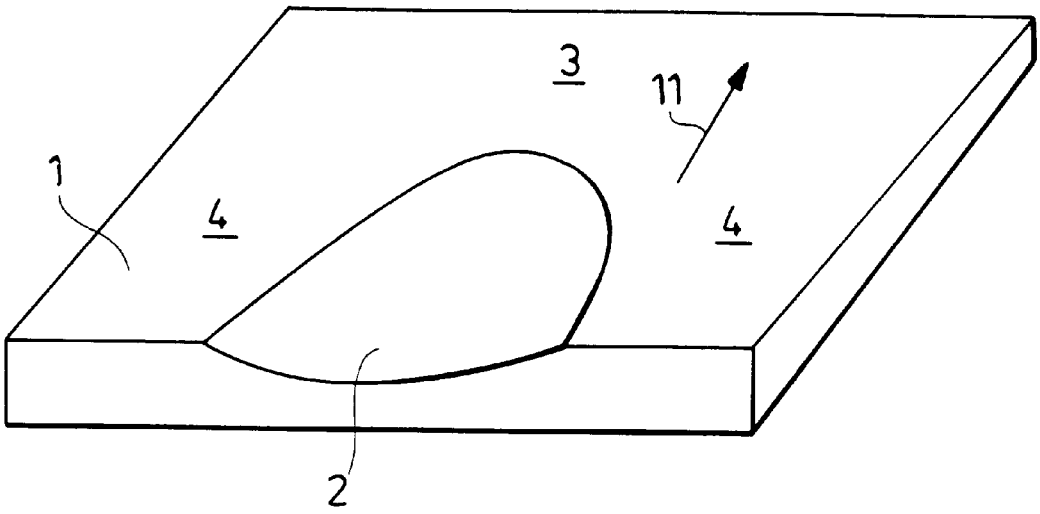
FIGS. 5*a–b* illustrate the work-hardening of the funnel area with a narrow saddle or top tool.
Figure 5B:
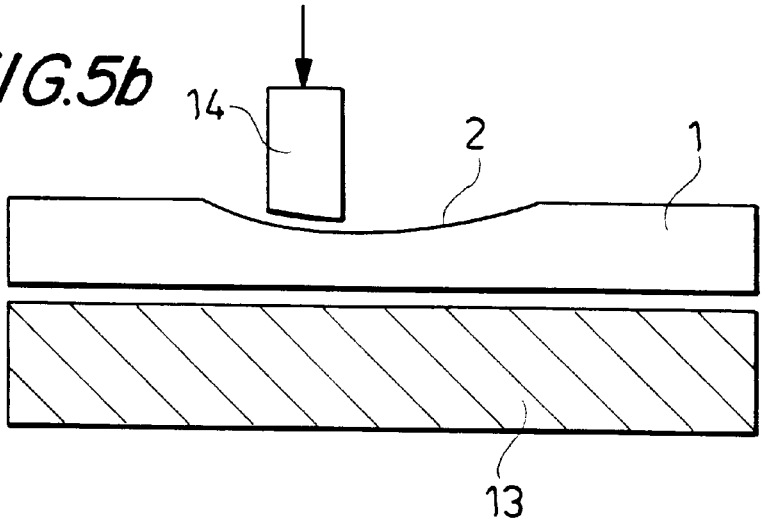

In a final processing step the wide sidewall member 1 according to FIG. 5 is placed onto a planar bottom saddle 13 and is work-hardened by approximately 25% by means of a narrow saddle 14, providing the top tool, purposely only within the funnel area.

While specific embodiments of the invention have been shown and described in detail to illustrate the inventive principles, it will be understood that the invention may be embodied otherwise without departing from such principles.

What is claimed is:

1. A method for manufacturing a sidewall member of a continuous casting mold from a copper blank, wherein the sidewall member has an upper and a lower edge and a curved widened area beginning at the upper edge and tapering in a direction to the lower edge and to the sides of the sidewall member, the method comprising the steps of:

a) hot-forging the copper blank via several intermediate shapes to a rectangular plate with an initial wedge shape;

b) further forming by final hot-forging the rectangular plate in a longitudinal direction of the rectangular plate with a straight saddle, having a width that is only a portion of a width of the rectangular plate measured relative to the longitudinal direction of the rectangular plate, and pre-forging the curved widened area;

c) subsequently quenching and work-hardening the rectangular plate;

d) subsequently cold-hammering the rectangular plate via a wedge-shaped bottom saddle for work-hardening a middle portion of the rectangular plate and for producing a final wedge shape of the rectangular plate; and e) finally work-hardening the entire curved widened area with a narrow saddle.

2. The method according to claim 1, wherein, before step e), the rectangular plate is cold-hammered and simultaneously extended in the longitudinal direction, transverse to a future casting direction, for work-hardening edge areas of the rectangular plate by a straight top saddle and a profiled bottom saddle, wherein the top and bottom saddles have linear dimensions that are greater than those of the rectangular plate.

3. The method according to claim 2, wherein the copper blank is a round block having a diameter of approximately 500 mm and a length of approximately 1,200 mm, wherein in step a) the copper blank is formed in four intermediate steps first to a barrel-shaped intermediate shape, then to a substantially square block, subsequently to a rectangular plate having dimensions of approximately 1,350 mm×900 mm×200 mm, and finally to the rectangular plate with the initial wedge shape having dimensions of 1,350 mm×1,150 mm×120/190 mm, and wherein the steps of cold-hammering result in the final shape of the rectangular plate of approximately 180 mm×1,150 mm×80/140 mm with work-hardening of the middle portion and the edge areas by approximately 25%.

4. The method according to claim 1, wherein in step e) the curved widened area is work-hardened by approximately 25%.

5. The method according to claim 1, wherein the sidewall member is for a thin slab continuous casting device.

* * * * *